US005630663A

United States Patent [19]

Ling et al.

[11] Patent Number: 5,630,663

[45] Date of Patent: May 20, 1997

[54] ADJUSTABLE TRIM FOR RECESSED LIGHTING FIXTURE

[75] Inventors: Geoffrey Ling, North Barrington; Alice M. Jandrisits; James B. Lee, both of Schaumburg, all of Ill.

[73] Assignee: Cooper Industries, Inc., Houston, Tex.

[21] Appl. No.: 631,011

[22] Filed: Apr. 12, 1996

[51] Int. Cl.[6] ..... F21S 1/06

[52] U.S. Cl. ..... 362/365; 362/282; 362/287; 362/372

[58] Field of Search ..... 362/282, 287, 362/365, 372, 404

[56] References Cited

U.S. PATENT DOCUMENTS 2,782,295 2/1957 Schwenkler ..... 362/365
5,268,824 12/1993 Czipri ..... 362/287
5,548,499 8/1996 Zadeh ..... 362/365

*Primary Examiner*—Carroll B. Dority
*Attorney, Agent, or Firm*—Burns, Doane, Swecker & Mathis, L.L.P.

[57] ABSTRACT

A recessed light fixture for a ceiling includes a trim ring, a pivot ring mounted on the trim ring for rotation about a vertical axis, and an enclosure portion rotatable about a horizontal axis intersecting the vertical axis. The enclosure portion includes upper and lower enclosures. The upper enclosure carries a lamp socket in horizontal offset relationship to the vertical and horizontal axes. The lamp socket defines a longitudinal axis which coincides with a center axis of a downwardly open circular mouth of the lower enclosure. The lower enclosure intersects the upper enclosure to form therewith a circular waist. Each of the upper and lower enclosures have a cross-sectional area increasing in size in a respective direction away from the waist. A center axis of the waist intersects the center axis of the mouth at an oblique angle.

18 Claims, 4 Drawing Sheets

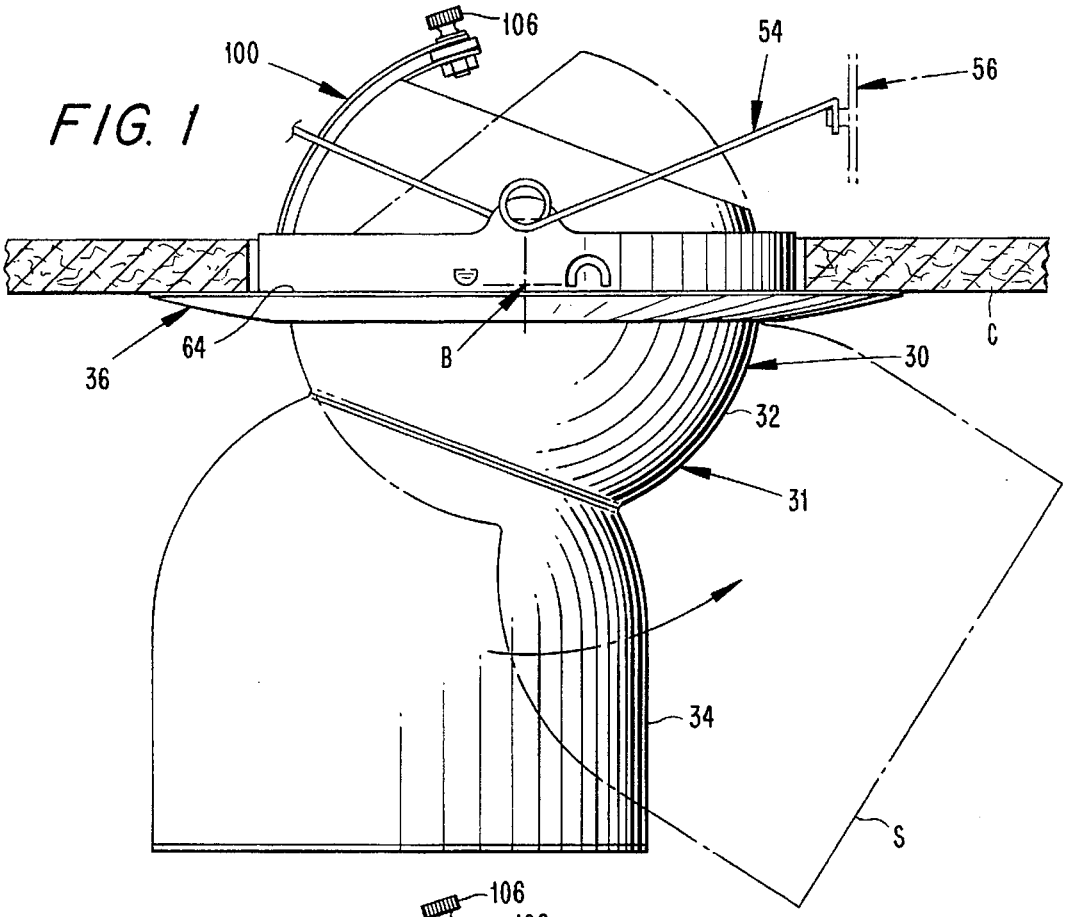
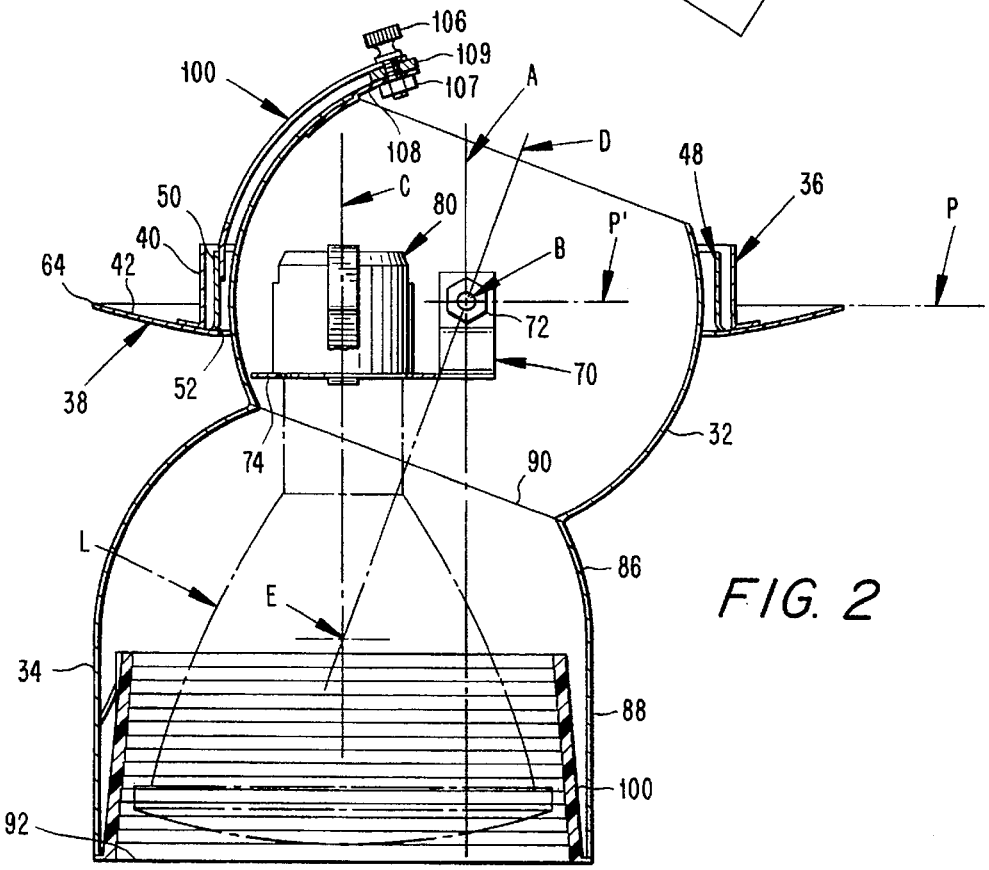
FIG. 2

FIG. 6
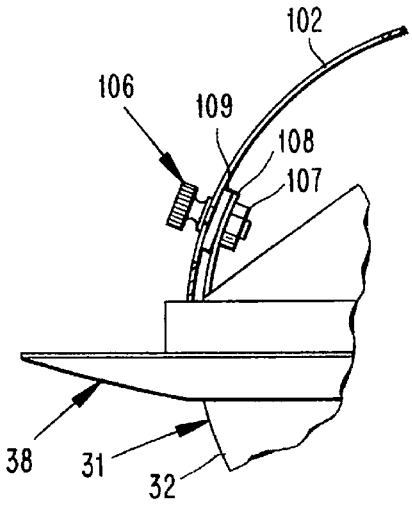
FIG. 8
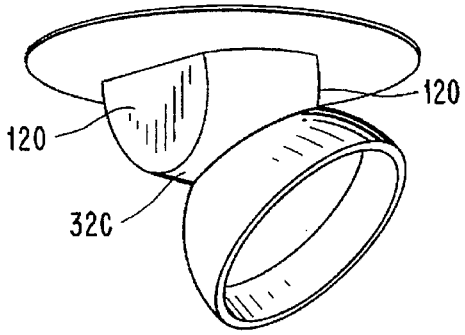
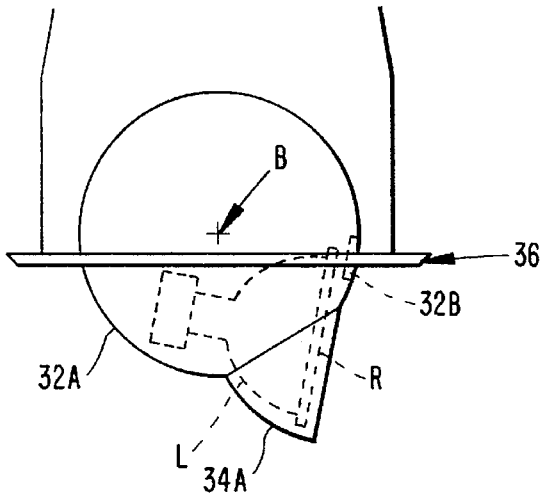
FIG. 7
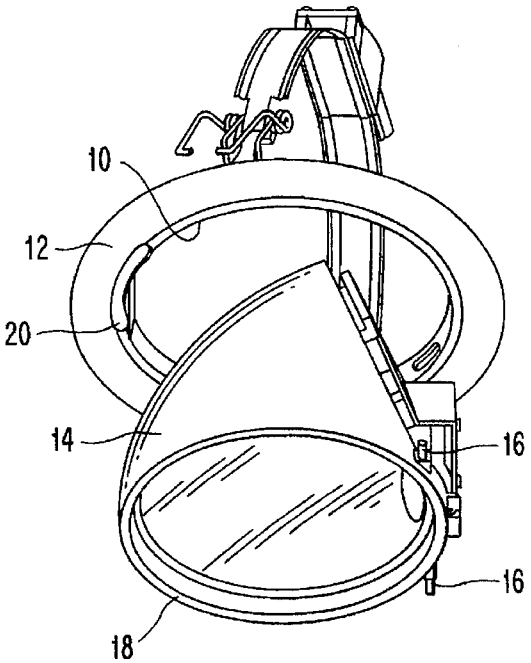
FIG. 9
(PRIOR ART)

ADJUSTABLE TRIM FOR RECESSED LIGHTING FIXTURE

RELATED INVENTION

This invention is related to an invention disclosed in the present inventors' concurrently filed design patent application Ser. No. 29-052,092.

BACKGROUND OF THE INVENTION

The present invention relates to recessed lighting fixtures and, in particular, to a trim portion of the fixtures which provides for increased adjustment of the direction of illumination.

Recessed lighting fixtures, especially those used in a ceiling are well known. In their simplest forms, such fixtures comprise a housing or can affixed to the ceiling structure, a trim mounted within the housing, and a socket mounted to the housing or trim for receiving a lamp. In a ceiling fixture, the lower end of the trim is flush with the ceiling surface, and the lamp is concealed within the trim. It will be appreciated that the lamp is afforded little possibility for adjustment to enable the light to be directed at a substantial angle relative to vertical.

Accordingly, fixtures have been provided which provide a greater degree of adjustment. For example, a so-called eye-ball type of recessed fixture is disclosed in Canadian Patent No. 547,770. In that fixture, a truncated spherical trim carries a lamp socket and is rotatable about vertical and horizontal axes in order to enhance the adjustability of the lamp.

A so-called elbow type of recessed fixture is depicted in FIG. 9 wherein a positioning ring 10 is mounted to a trim ring 12 for rotation relative thereto about a vertical axis. A housing 14 is mounted to the positioning ring by means of pins 16 to enable the housing to rotate relative to the positioning ring about a horizontal axis defined by the pins 16. That axis extends tangentially relative to a lower open end 18 of the housing. It will be appreciated, then, that the housing can rotate about a vertical axis along with the positioning ring 10, and also can rotate about a horizontal axis defined by the pins 16. This allows the housing to be disposed in an upward or recessed state wherein the lower open end 18 of the housing is substantially flush with the ceiling surface. In that recessed state, the housing is held against pivoting by a pivotable locking arm 20 carried by the positioning ring. When the locking arm is rotated radially outwardly from beneath the lower open end of the housing, the housing is free to pivot downwardly about the horizontal pivot axis. This enables a lamp carried by the housing to become oriented at an angle relative to vertical. Shortcomings of such an elbow-type fixture include increased manufacturing costs due to the housing being of two-piece construction, resulting in a visible seam running vertically down the center. Also, the lamp is located within the recessed housing when the trim is retracted (i.e., flush with the ceiling), so the housing diameter must be relatively large in order to accommodate the lamp.

Other types of recessed fixtures are known, such as a so-called pull-down type disclosed in U.S. Pat. Nos. 4,636,924 and 5,404,297 wherein a lamp-carrying portion of the trim can be displaced vertically downwardly in order to maximize the adjustability of the illumination direction. Such a fixture is expensive, results in exposed hardware, and increases the visibility of the housing interior.

It is clear that room for improvement remains, especially with regards to increasing the adjustability of the illumination direction without significantly increasing the cost or size of the fixture, or resulting in fixture hardware becoming exposed, or the interior of the can becoming highly visible from below.

SUMMARY OF THE INVENTION

The invention relates to a recessed light fixture for use in a ceiling, comprising a trim ring, an enclosure unit, and a lamp socket-mounting structure. The trim ring defines a longitudinal first axis. The enclosure unit is mounted to the trim ring and includes upper and lower enclosures. The upper enclosure is mounted to the trim ring for rotation relative to the trim ring about the first axis and about a second axis intersecting the first axis perpendicularly thereto. The second enclosure intersects the first enclosure to form therewith a waist arranged to be disposed below the ceiling. The second enclosure includes a downwardly open mouth. The lamp socket-mounting structure is fixed within the upper enclosure for positioning a lamp socket along a longitudinal axis. Each of the upper and lower enclosures has a cross-sectional area increasing in size in a respective direction away from the waist.

Preferably, the longitudinal axis is offset from the first axis and coincides with a center axis of the mouth.

A center axis of the waist preferably forms an oblique angle with the center axis of the mouth.

A plane containing the second axis and oriented perpendicular to the first axis preferably passes through the lamp socket.

The trim ring preferably includes a ring portion having an outer edge. A plane containing the outer edge preferably passes through the socket. A portion of the upper enclosure is disposed above the plane, and another portion of the upper enclosure is disposed below the plane.

Preferably, a pivot ring is mounted to the trim ring for rotation about the first axis, the enclosure portion being mounted to the pivot ring for rotation about the second axis.

BRIEF DESCRIPTION OF THE DRAWINGS

The objects and advantages of the invention will become apparent from the following detailed description of a preferred embodiment thereof in connection with the accompanying drawing in which like numerals designate like elements and in which:

FIG. 1 is a side elevational view of a trim structure according to the present invention mounted in a ceiling, with rotational positions of adjustment of the trim being shown in broken lines;

FIG. 2 is a vertical sectional view taken through the trim of FIG. 1;

FIG. 6 is a fragmentary view showing the locking mechanism in a different position of adjustment than in FIG. 2;

FIG. 7 is a schematic side elevational view of another preferred embodiment of the invention;

FIG. 8 is a perspective view of yet another preferred embodiment of the invention; and FIG. 9 is an exploded perspective view of a prior art elbow type light fixture to be recessed in a ceiling.

DETAILED DESCRIPTION OF A PREFERRED EMBODIMENT OF THE INVENTION

Figure 3:
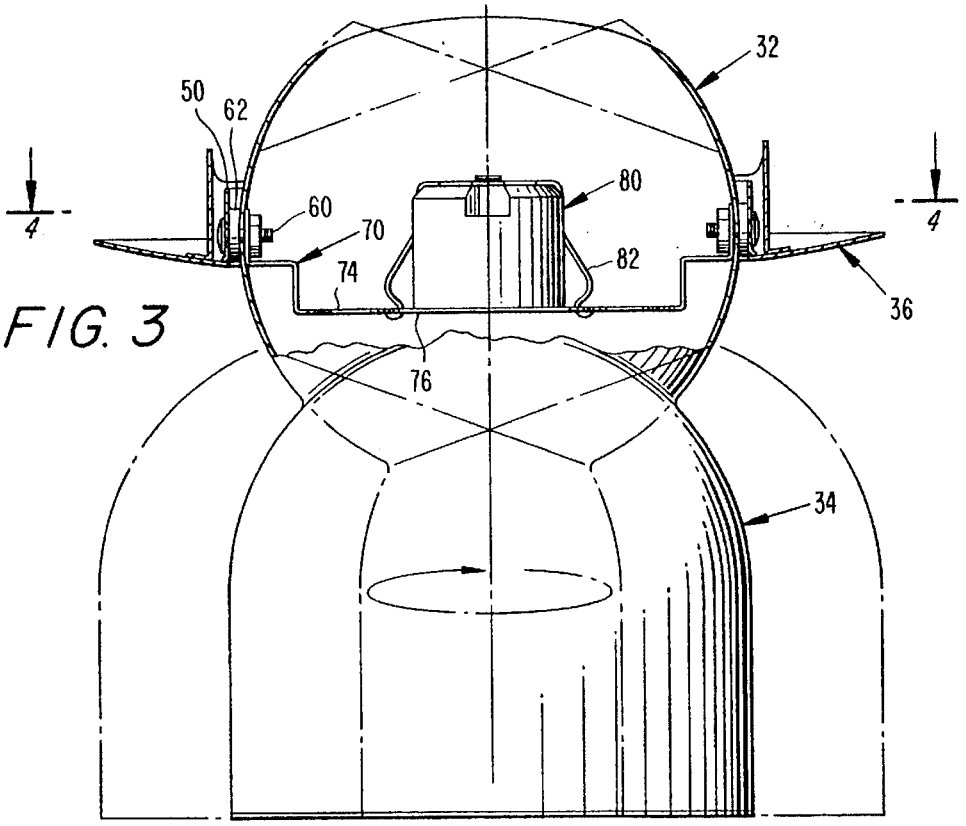
FIG. 3 is a vertical sectional view taken through the trim along a plane oriented 90° relative to the plane producing FIG. 2.

Depicted in FIGS. 1–5 is a trim 30 for use in a recessed light fixture intended especially for a recessed ceiling fixture. The trim includes an enclosure unit 31 having upper and lower enclosures 32, 34 and a trim ring unit 36. The trim ring unit 36 (see FIG. 5) includes a ring portion 38 and a cylindrical portion 40 affixed to an upper surface 42 of the ring portion and arranged coaxially with a center axis A of the ring portion.

The cylindrical portion 40 is affixed to the ring portion by means of a bent end 40 of the cylindrical portion 40 which is attached to the ring portion 38.

A section of the ring portion 38 situated radially inwardly of the cylindrical portion 40 defines a ledge 46. Seated on the ledge 46 is a pivot ring 48. The pivot ring 48 includes a cylindrical portion 50 having a bent end 52 that rests on the ledge The cylindrical portion 40 of the trim ring 36 carries a pair of diametrically spaced torsion springs 54 (only one torsion spring shown in the drawing (see FIG. 1)) for securing the trim 50 to an outer housing or can 56 in a conventional manner.

The upper enclosure 32 is pivotally mounted to the pivot ring 48 for pivotal movement about an axis B extending perpendicular to the center axis A which is common to the trim ring unit 36 and pivot ring 48. The pivot axis B is defined by a pair of pivot pins or rivets 60 extending through the upper enclosure 32 and the cylindrical portion 50 of the pivot ring 48. Each pivot pin 60 passes through a spacer 62 which maintains a radial spacing between the cylindrical portion 50 and the upper enclosure 32.

The enclosure unit 31 is thus able to rotate, along with the pivot ring 48, about the axis A relative to the trim ring unit 36, and to rotate relative to both the trim ring unit 36 and pivot ring 48 about the axis B.

The axis B lies substantially within a plane P (FIG. 2) containing an outer edge 64 of the frusto-conical portion 38 of the trim ring unit 36, although alternatively the axis B could be spaced by an appreciable distance from the plane P.

Figure 4:
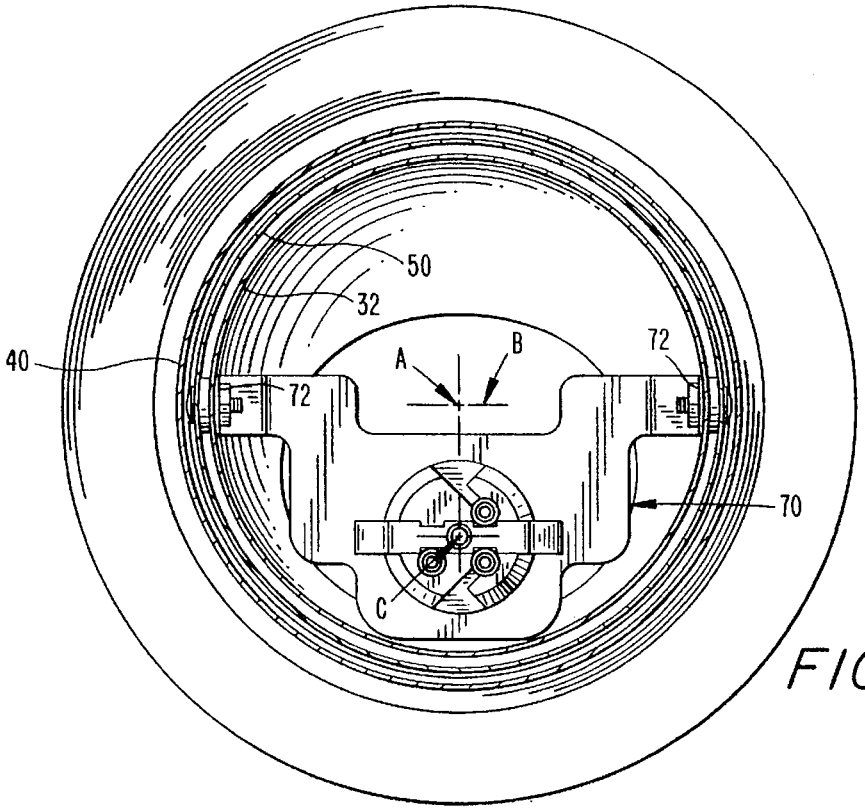
FIG. 4 is a cross-sectional view taken along the line 4—4 in FIG. 3.
Figure 5:
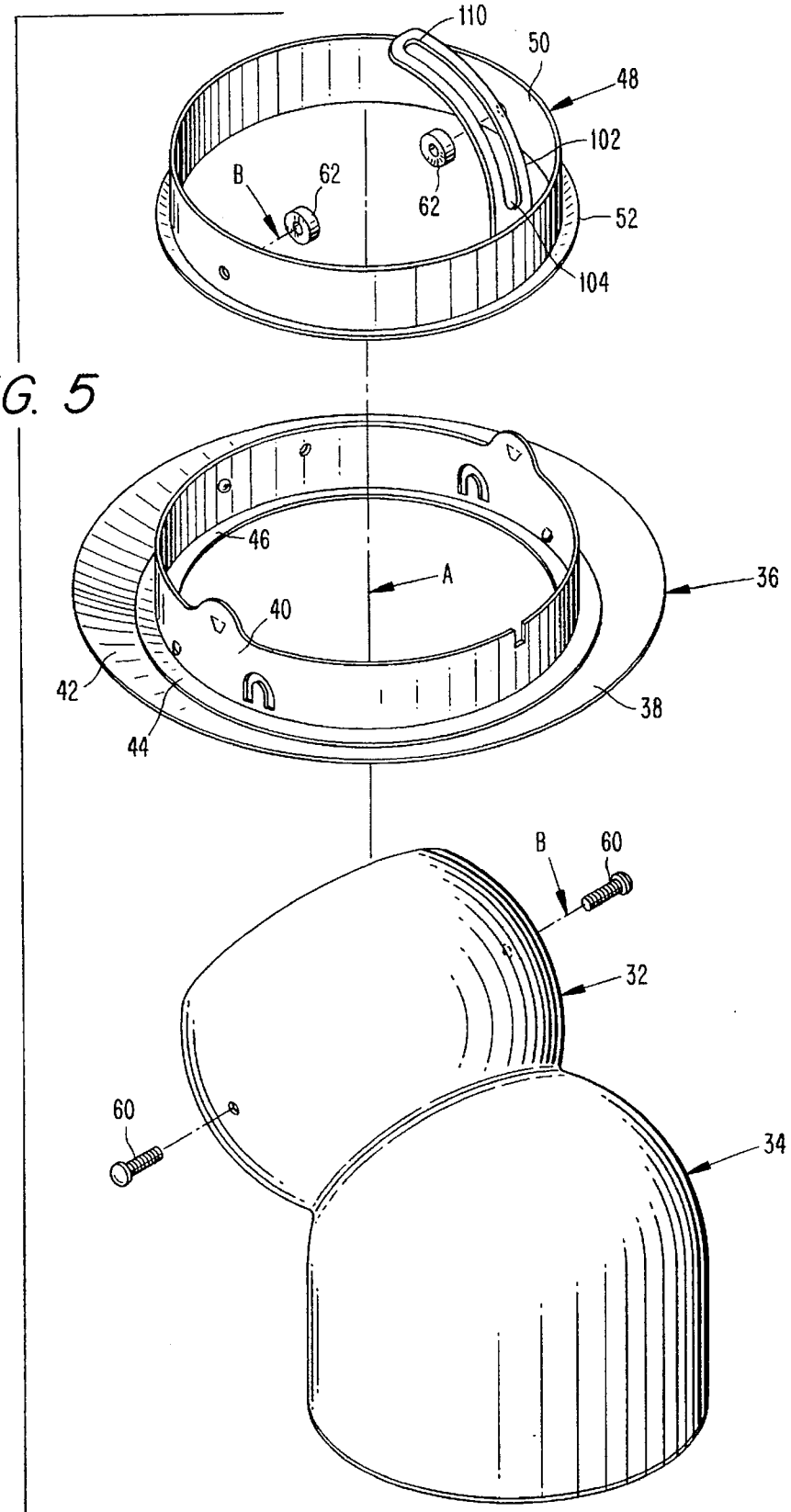
FIG. 5 is an exploded perspective view of the trim depicted in FIG. 1.

The upper enclosure 32 is of double-truncated spherical shape, with the axis B extending through the spherical geometrical center. Mounted to an inner surface of the upper enclosure 32 is a carrier plate 70. That plate 70 includes a pair of ears 72 connected by the pivot pins 60 to the upper enclosure 32 preferably in a rigid, non-adjustable manner, and a support table 74 having an aperture 76 in which is mounted a conventional lamp socket 80 by means of spring legs 82. The longitudinal axis C of the socket 80 is parallel to, and offset from, the axis A as can be seen in FIGS. 2 and 4. The axis C extends orthogonally relative to the axis B. Also, a plane P containing the axis B and oriented perpendicular to the axis A passes through the socket 80, although alternatively the plane P could be in non-intersecting relationship with the socket 80.

The lower enclosure 34 includes a truncated spherical segment 86 merging into a cylindrical segment 88. The spherical segment 86 intersects the upper enclosure 32 to define a waist 90 of the enclosure unit 31. It will be appreciated that the cross-sectional area of each of the upper and lower enclosures 32, 34 increases in a direction away from the waist 90, i.e., the waist defines a region of minimum cross-section of the trim unit 31.

The cylindrical segment 88 of the lower enclosure 34 forms a downwardly open circular mouth 92 arranged such that the axis C of the socket coincides with a center axis of what mouth. Thus, the axis C coincides with a longitudinal axis of the cylindrical segment 88 and is offset horizontally with respect to the axes A and B. A center axis D of the waist 90 forms an oblique angle with the center axis C of the mouth 92.

The center axes C and D of the mouth 92 and waist 90, respectively, intersect one another at a geometrical center E of the spherical section 86 of the lower enclosure.

Alternatively, the axes A, C and D could coincide with one another.

Instead of being part spherical and part cylindrical, the lower enclosure 34 could be only spherical, i.e., a double truncated sphere, similar to the upper enclosure 32. In that event, the axes C and D would intersect at the spherical geometrical center of the lower enclosure and would also pass through the center of a downwardly open circular mouth defined by the lower enclosure.

Alternatively, as shown in FIG. 7, in the event that the lower enclosure 34A were spherical, it could be in the form of a relatively small spherical segment, which is substantially smaller than the upper enclosure 32A. Accordingly, only a portion of the rim R of the lamp L would be disposed in the lower enclosure 34A, and the rest of the rim R would be disposed in the upper enclosure 32A. Also, a part 32B of the upper enclosure would be cut out to provide access for the lamp L.

Mounted at a lower end of the lower enclosure 34 is a conventional baffle 100 having a stepped inner surface for preventing the downward reflection of light.

In order to lock the enclosure unit 31 in various positions of rotation relative to the pivot ring 48 (i.e., rotation about the axis B), a locking mechanism 100 (see FIG. 2) is provided. The locking mechanism 100 includes a curved plate 102 affixed to the cylindrical portion 50 of the pivot ring 48. That plate 102 includes a slot 104 (see FIG. 5) permitting sliding movement of a locking screw 106 which is attached to a tab 108 projecting from an upper edge of the upper enclosure 32. The screw 106 is threaded into a nut 107 disposed on the underside of the tab 108, and a spacing washer 109 is disposed between the tab 108 and the plate 102. Upon loosening the screw 106, the enclosure unit 31, together with the screw 106, can be rotated relative to the pivot ring 48 about the axis B. Then, the locking screw 106 can be tightened to lock the enclosure unit in a desired position, as shown in FIG. 6.

It will also be appreciated that the upper edge 110 of the slot 104 acts as a stop to prevent rotation of the enclosure unit 31 in a clockwise direction from the solid line position of FIG. 1. Thus, the unit 31 rotates in such a direction (i.e., counterclockwise in FIG. 2) that the socket 80 moves downwardly when the axis C is being displaced from a vertical orientation.

It will be appreciated that when a lamp L is screwed into the socket 80 a substantial portion of the lamp extends below the plane P. Hence, the enclosure unit 31 can be rotated about the axis B (see FIG. 1) to a position S wherein the socket 80 is situated below the level of ceiling, due to the fact that the socket was initially located in the plane P and the axis C of the socket is offset relative to the axes A and B when it was in a vertical orientation. This enables the lamp to project in a direction forming a relative large angle relative to vertical. Furthermore, the enclosure unit 31 can be rotated about the axis A to project the light in any direction about that axis.

As shown in FIG. 8, instead of the spherical upper enclosure being of double-truncated shape, it could be provided with two additional truncations to form flats at opposite sides of the upper enclosure through which the axis B extends. Thus, in FIG. 8, two flats 120 are formed in the sides of the spherical upper enclosure 32C.

It will be appreciated that the present invention provides a low-cost recessed fixture which affords a high degree of adjustability of the light direction. The fact that the socket 80 is offset from the axis B, and the waist 90 (and thus also the lower enclosure) is arranged so as to be situated below the level of the ceiling (i.e., below the level of the trim ring unit 36) when the axis C is in a vertical orientation, ensures that the lamp L will have a wide angle of adjustment about the axis B. The fact that the axes C and D form an oblique angle relative to another further contributes to the ability of the lamp to be adjusted within a relative wide angle.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed:

1. A recessed light fixture for mounting in a ceiling, comprising:

a trim ring defining a longitudinal first axis;

an enclosure unit mounted to the trim ring, the enclosure unit including upper and lower enclosures, the upper enclosure mounted to the trim ring for rotation relative to the trim ring about the first axis and about a second axis intersecting the first axis perpendicularly thereto, the second enclosure intersecting the first enclosure to form therewith a waist arranged to be disposed below the ceiling, the second enclosure including a downwardly open mouth, each of the upper and lower enclosures having a cross-sectional area increasing in size in a respective direction away from the waist; and a lamp socket-mounting structure fixed within the upper enclosure for positioning a lamp socket along a longitudinal axis which is offset from the first axis.

2. The fixture according to claim 1, wherein a center axis of the waist forms an oblique angle with the center axis of the mouth.

3. The fixture according to claim 1 further including a lamp socket mounted to the lamp socket-mounting structure, wherein a plane containing the second axis and oriented perpendicular to the first axis passes through the lamp socket when the longitudinal axis is oriented vertically.

4. The fixture according to claim 1 further including a lamp socket mounted to the lamp socket-mounting structure, wherein the trim ring includes a ring portion having an outer edge lying in a plane; a portion of the upper enclosure being disposed above the plane, and another portion of the upper enclosure being disposed below the plane.

5. The fixture according to claim 1, wherein the longitudinal axis is offset from the first axis and coincides with a center axis of the mouth.

6. The fixture according to claim 1, wherein the upper enclosure comprises a double-truncated sphere.

7. The fixture according to claim 5, wherein the lower enclosure includes a spherical segment intersecting the upper enclosure, and a cylindrical segment forming the mouth.

8. The fixture according to claim 1 further including a pivot ring mounted to the trim ring for rotation about the first axis, the enclosure portion mounted to the pivot ring for rotation about the second axis.

9. The fixture according to claim 1, wherein the first axis is vertical and the second axis is horizontal when the fixture is mounted in a ceiling.

10. The fixture according to claim 1, wherein the lamp socket forms a longitudinal axis coinciding with the axis of the mouth.

11. The fixture according to claim 1 including a locking mechanism for securing the enclosure unit in respective positions of rotary adjustment relative to the trim ring.

12. A recessed light fixture comprising:

a trim ring defining a longitudinal first axis, a pivot ring mounted to the trim ring for rotation relative thereto about the first axis, an enclosure unit including upper and lower enclosures, the upper enclosure being mounted to the pivot ring for rotation relative thereto about a second axis intersecting the first axis perpendicularly thereto, the first and second enclosures intersecting one another to form a circular waist, the second enclosure including a downwardly open circular mouth arranged such that a center axis of the waist and a center axis of the mouth intersect one another at an oblique angle; and a lamp socket-mounting structure fixed to the upper enclosure for positioning a lamp socket along a longitudinal axis offset from the first axis and coinciding with the axis of the mouth.

13. The fixture according to claim 12 further including a lamp socket mounted to the lamp-socket mounting structure, wherein a plane containing the second axis and oriented perpendicular to the first axis passes through the lamp socket when the longitudinal axis is oriented vertically.

14. The fixture according to claim 12, further including a lamp socket mounted to the lamp socket-mounting structure, wherein the trim ring includes a ring portion having an outer edge lying in a plane, a portion of the upper enclosure being disposed above the plane, and another portion of the upper enclosure being disposed below the plane.

15. The fixture according to claim 12, wherein each of the upper and lower enclosures has a cross-sectional area increasing in a direction away from the waist.

16. The fixture according to claim 12, wherein the pivot ring is mounted to the upper enclosure by pins defining the second axis; the lamp socket-mounting structure comprising a plate attached to the pins.

17. The fixture according to claim 12, wherein the upper enclosure comprises a double truncated sphere.

18. The fixture according to claim 12, further including a locking mechanism for securing the enclosure unit in respective portions of rotary adjustment relative to the pivot ring.

* * * * *